US010780716B1

(12) United States Patent
Praharaj et al.

(10) Patent No.: US 10,780,716 B1
(45) **Date of Patent: *Sep. 22, 2020**

(54) SYSTEM AND DEVICE FOR ATTENUATING CURL IN SUBSTRATES PRINTED BY INKJET PRINTERS

(71) Applicant: Xerox Corporation, Norwalk, CT (US)

(72) Inventors: Seemit Praharaj, Webster, NY (US); Douglas K. Herrmann, Webster, NY (US); Jason M. LeFevre, Penfield, NY (US); Paul J. McConville, Webster, NY (US); Chu-Heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/406,557

(22) Filed: May 8, 2019

(51) Int. Cl.
*B41J 11/00* (2006.01)

(52) U.S. Cl.
CPC ..... *B41J 11/0015* (2013.01)

(58) Field of Classification Search
CPC ..... B41J 11/0015; B41J 11/002; B41J 2/01
USPC ..... 347/16, 101–103
See application file for complete search history.

(56) References Cited

U.S. PATENT DOCUMENTS

| | | | | |
|---|---|---|---|---|
| 2,022,593 | A | 11/1935 | Fuykers | |
| 4,697,514 | A | 10/1987 | George et al. | |
| 5,371,531 | A | 12/1994 | Rezanka et al. | |
| 5,764,263 | A | 6/1998 | Lin | |
| 6,076,921 | A | 6/2000 | Rezanka et al. | |
| 6,132,038 | A | 10/2000 | Szlucha | |
| 6,428,160 | B2 | 8/2002 | Roy et al. | |
| 6,799,759 | B1 | 10/2004 | McNamara et al. | |
| 8,038,280 | B2 | 10/2011 | Scarlata | |
| 9,403,358 | B1 * | 8/2016 | Ferrara, Jr. | B41J 11/0015 |
| 10,350,912 | B1 * | 7/2019 | Herrmann | B41J 13/106 |
| 2007/0021905 | A1 | 1/2007 | Lim | |
| 2011/0050824 | A1 | 3/2011 | Toya et al. | |
| 2017/0087874 | A1 | 3/2017 | Maida | |

* cited by examiner

*Primary Examiner* — An H Do

(74) *Attorney, Agent, or Firm* — Maginot Moore & Beck LLP

(57) ABSTRACT

An aqueous ink printer includes a moisture applicator that applies moisture to a side of a substrate that is opposite a side that bears or will bear an ink image. The moisture applicator includes a switching network that is configured to independently and selectively bias the tile segments electrically. The tile segments contiguously cover a surface of the roller. As the switching network is operated to electrically bias the tile segments using data corresponding to the ink image, they transition from being hydrophobic to hydrophilic so the electrically-biased hydrophilic tile segments attract moisture from water in a trough or from water vapor produced by an ultrasonic transducer in the trough. The moisture is carried by the electrically-biased tile segments to the substrate at areas where the amount of ink in a portion of the substrate on the other side of the substrate exceeds a predetermined ink coverage threshold.

21 Claims, 2 Drawing Sheets

SYSTEM AND DEVICE FOR ATTENUATING CURL IN SUBSTRATES PRINTED BY INKJET PRINTERS

TECHNICAL FIELD

This disclosure relates generally to inkjet printing systems, and more particularly, to addressing curl produced in substrates printed by such printers.

BACKGROUND

Inkjet printing systems form images on substrates with drops of ink. Whether an image is printed directly onto a substrate or transferred from a blanket configured about an intermediate transfer member, once the image is on the substrate, the water and other solvents in the ink begin to be absorbed by the substrate. Eventually, the water and other solvents are removed from the surface by drying the image. During manufacture of fibrous substrates, such as paper substrates, the substrates are stretched and then dried. The extensional stretch is fixed in the substrates by the drying. When the substrate is wetted again during printing, the extensional stretch is released. Subsequent drying of the substrate can cause the substrate to shrink from its pre-printing dimensions. These issues are particularly apparent in printers that form images with aqueous inks. The water in these inks release the extensional stress. Even after the substrates are dried after printing, humectants and some moisture remain in the substrates and can continue to shrink the substrates for even days after the printing of the substrates. Although practically all of the moisture and humectants eventually leave the substrate, the shrinkage that occurs before this level of dryness is reached can cause the substrates to curl. In some cases, the magnitude of the curl can be significant and persistent. As the curled substrates fill the output tray, this unevenness can present issues for stacking the printed substrates in the tray and the degree of unevenness in the surface of the substrates can impact the desirability of the printed sheets for the user. Being able to retain the original size and flatness of the substrates after inkjet printing and drying would be beneficial.

SUMMARY

A new printing system includes a moisture applicator that treats substrates to reduce the curling of the substrates caused by inkjet printing and drying. The system includes at least one printhead configured to eject drops of an aqueous ink, a substrate transport system configured to move substrates past the at least one printhead to enable the at least one printhead to eject drops of the aqueous ink onto the substrates to form aqueous ink images on the substrates, a moisture applicator configured with a plurality of tile segments to apply moisture selectively to a side of the substrates opposite a side on which the at least one printhead forms aqueous ink images on the substrates, each tile segment being configured to be hydrophobic when not electrically biased and to be hydrophilic when electrically biased, and a switching network having a plurality of switches, the switching network being configured to apply electrical energy to electrically bias the tile segments independently and selectively.

A new moisture applicator treats substrates in a printer to reduce the substrate curling caused by inkjet printing and drying. The moisture applicator includes a plurality of tile segments, each tile segment being configured to be hydrophobic when the tile segment is not electrically biased and to be hydrophilic when the tile segment is electrically biased, and a switching network having a plurality of switches, the switches being operatively connected to the plurality of tile segments and the switching network being configured to independently and selectively bias the tile segments in the plurality of tile segments electrically.

BRIEF DESCRIPTION OF THE DRAWINGS

The foregoing aspects and other features of a substrate treatment system that reduces the curling of the substrates in a printer are explained in the following description, taken in connection with the accompanying drawings.

DETAILED DESCRIPTION

Figure 1:
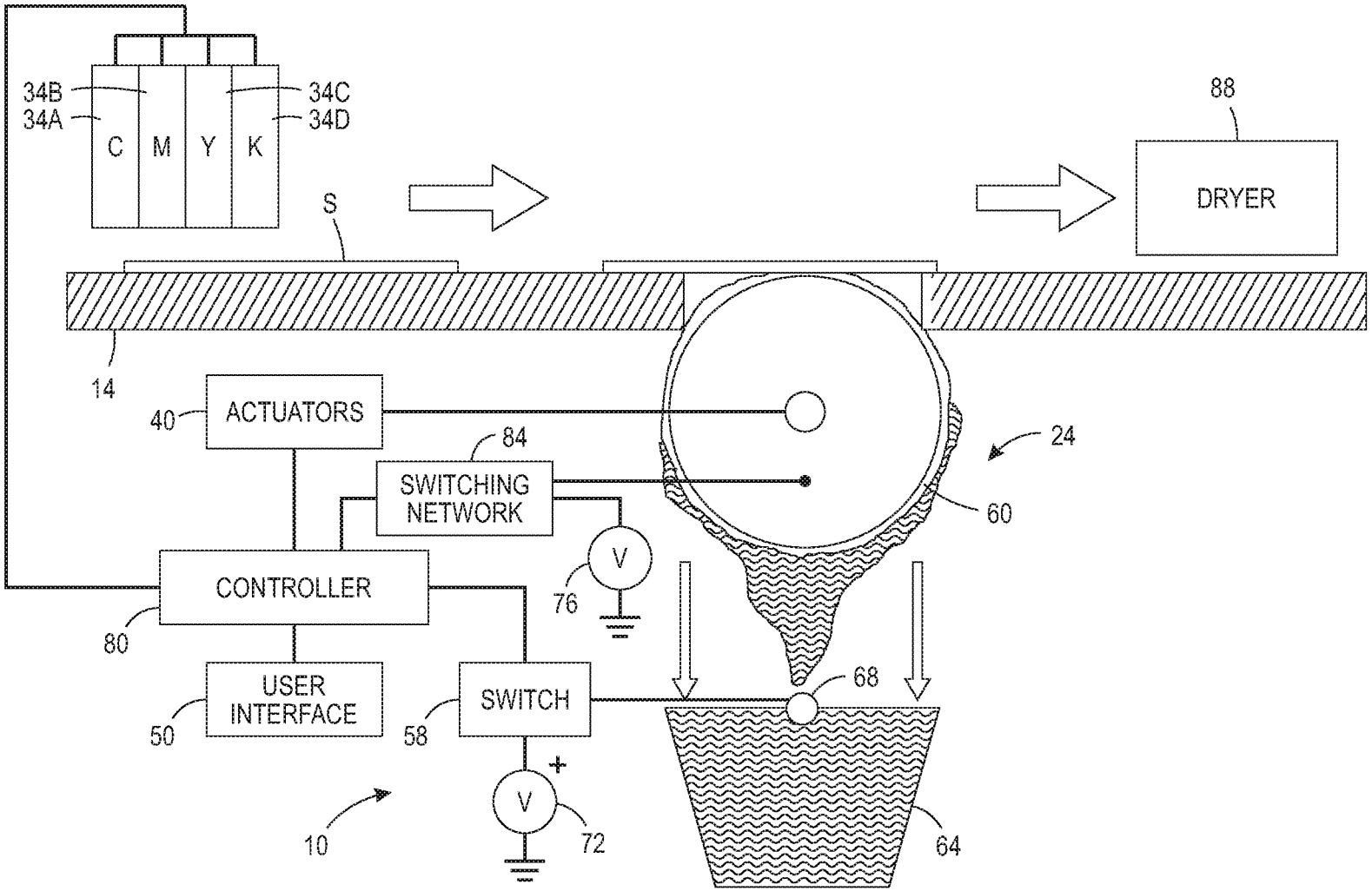
FIG. 1 is a block diagram of an aqueous ink printing system that enables efficient drying of aqueous ink images without appreciable additional complexity or significant increases in drying temperatures.

For a general understanding of the present embodiments, reference is made to the drawings. In the drawings, like reference numerals have been used throughout to designate like elements.

FIG. 1 illustrates a high-speed aqueous ink printing system or printer 10 that has been configured with a moisture applicator 24 to attenuate curl induced in the substrates printed by the printer 10. As illustrated, the printer 10 directly forms an ink image on a surface of a substrate S transported through the printer 10 by a transport system 14. The transport system 14 can include an endless belt that is wrapped about a pair of rollers. Other known transport systems can be used, such as driven rollers. Controller 80 operates actuators 40 so the transport system 14 moves the substrates over the moisture applicator 24 before continuing along the transport system to other substrate processing stations. Printhead modules 34A, 34B, 34C, and 34D are positioned opposite the transport system 14 to print an ink image on the substrate S before the substrate reaches the moisture applicator 24. In another embodiment, the printhead modules are positioned to print the ink image on the substrate after the moisture applicator 24 has treated the surface not being printed by the printhead modules. That is, the substrate S can be treated by the moisture applicator 24 either before or after being printed by the printhead modules.

The controller 80 receives data for an image to be formed on a substrate and renders that data into halftone data for operating the printhead or printheads within each printhead module in a known manner. The ejectors in the printheads eject drops of ink onto the substrate S as the substrate passes the printhead modules to form ink images on the substrate. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction. Printer 10 can also be a printer that has a moving web rather than a transport system 14 so the web can move past the printheads for the printing of images on the web. As used in this document, the term "process direction" refers to the direction of substrate movement through the printer 10 and the term "cross-process direction" refers to a direction that is perpendicular to the process direction in the plane of the substrate.

An aqueous ink delivery subsystem has at least one ink reservoir containing one color of aqueous ink for each printhead module. Since the illustrated printer 10 is a multicolor image producing machine, the ink delivery system has four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the delivery system are also operatively connected between the ink reservoirs and the printheads within the printhead modules to perform manifold and inkjet purges. Additionally, although not shown in FIG. 1, each printhead in a printhead module is connected to a corresponding waste ink tank with a valve to enable the collection of purged ink during manifold and inkjet purge operations. The printhead modules 34A-34D can include associated electronics for operation of the one or more printheads by the controller 80 although those connections are not shown to simplify the figure. Although the printer 10 includes four printhead modules 34A-34D, each of which has two arrays of printheads, alternative configurations include a different number of printhead modules or arrays within a module. The controller 80 also operates the moisture applicator 24 to treat the substrates either before or after printing to attenuate curl induced in the substrate by printing alone.

Operation and control of the various subsystems, components and functions of the machine or printer 10 are performed with the aid of a controller or electronic subsystem (ESS) 80. The ESS or controller 80 is operably connected to the components of the ink delivery system, the moisture applicator 24, the printhead modules 34A-34D (and thus the printheads), and the actuators 40. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an ink image to be produced are sent to the controller 80 from either a scanning system or an online or work station connection for rendering and generation of the printhead control signals output to the printhead modules 34A-34D and the signals that operate the moisture applicator 24 to apply moisture to the substrate S. Additionally, the controller 80 determines and accepts related subsystem and component controls, for example, from operator inputs via the user interface 50 and executes such controls accordingly. As a result, aqueous ink for appropriate colors are delivered to the printhead modules 34A-34D.

The moisture applicator 24 includes a roller 60 that is positioned over a trough 64 containing water. An ultrasonic transducer 68 is positioned within the trough 64 and is electrically connected to a voltage source 72 through a switch 58. The voltage source can be a DC voltage source that alternates between electrical ground and a positive or negative voltage. Alternatively, the voltage source 72 can be an AC source. The controller 80 is operatively connected to the switch 58 so the controller 80 can operate the switch to connect the ultrasonic transducer 68 to the voltage source 72 selectively. When the transducer 68 is connected to the voltage source 72, the transducer vibrates within the water. This vibration produces water vapor that rises to contact the roller 60. Roller 60 has a length that is at least as long as the substrates to be printed are wide. The roller 60 rotates about its longitudinal axis above the trough 64 at a distance in a range of about 1.0 cm to about 30 cm from the volumetric center of the trough so the water vapor contacts the surface of the roller 60. This distance depends upon the power of the diffuser and related parameters. In other embodiments, the trough 64 is positioned so the roller 60 is partially immersed in the water contained in the trough 64 but the upper portion of the roller still contacts the substrate S in the gap between the two portions of the transport system 14. In this embodiment, no transducer 68, voltage source 72, or switch 58 is required. While the moisture applicator has been described as including a roller, other shaped members and configurations can be used, such as a rotating belt.

Figure 2:
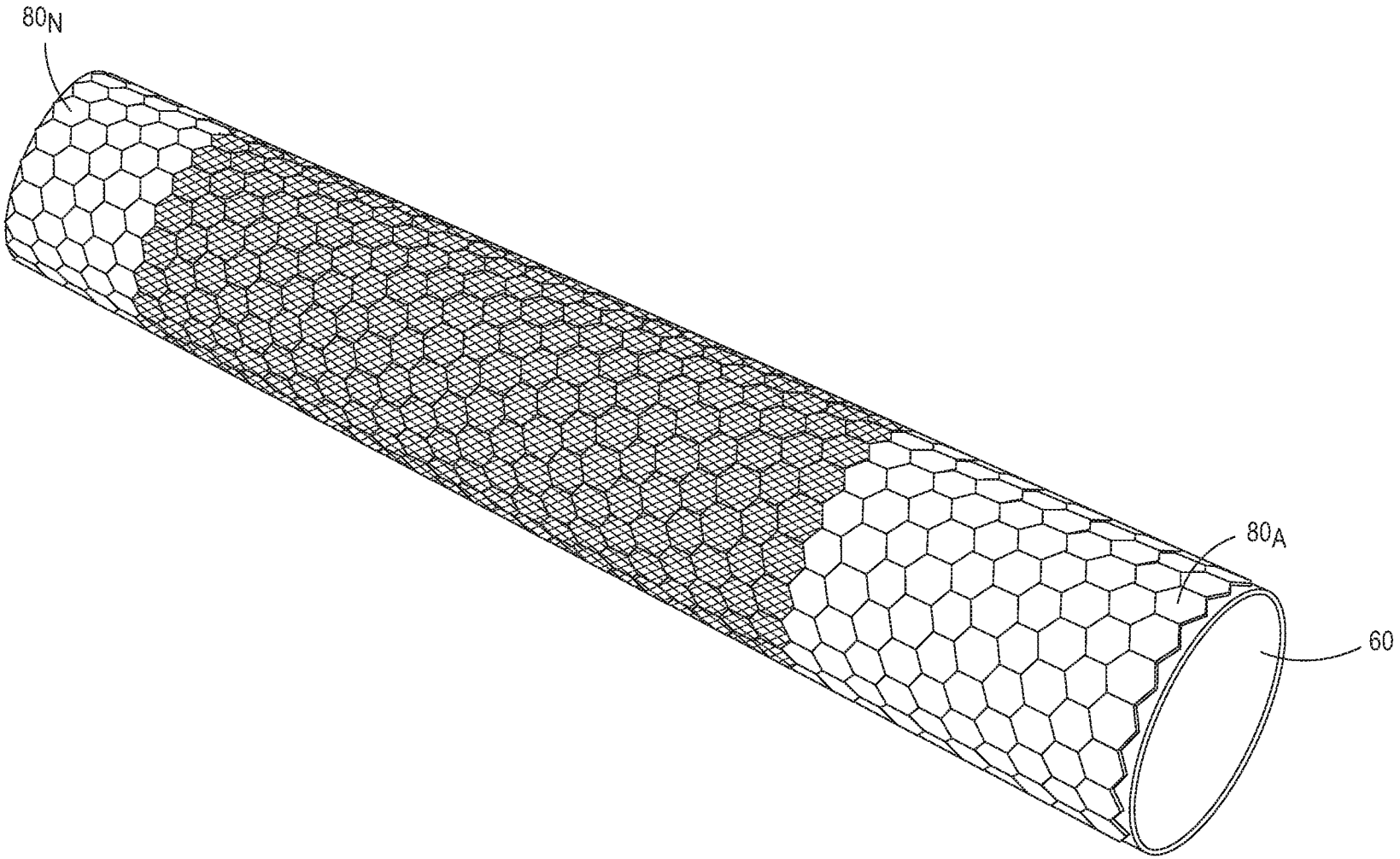
FIG. 2 is a view of a roller having tile segments used in the moisture applicator of the printing system shown in FIG. 1.

As shown in FIG. 2, the roller 60 is comprised of tile segments 80A to 80N that are electrically insulated from one another so the segments can be independently and selectively biased electrically using, for example, the voltage source 76, which is applied to the tile segments by operating the switches in the switching network 84. Within the internal volume of roller 60, each segment is electrically connected to an electrode and each electrode is independently connected to the voltage source 76 through a switching network 84. The controller 80 is operatively connected to the switching network 84 and is configured to operate the switches in the network 84 independently and selectively to apply electrical energy to the segments to bias the tile electrically. As shown in the figure, the tile segments are hexagonal shaped, although other polygonal shapes can be used provided they enable the tiles to cover the surface of the roller 60 contiguously between its ends. Additionally, the tiles segments can be shaped irregularly so the length of a tile in the process direction is not the same as the width of the tile in the cross-process direction. In some embodiments, the segments are a few millimeters wide in the cross-process direction and a few millimeters long in the process direction. In one embodiment, the tile segments have a surface area in a range of about 2.0 $cm^2$ to about 4.0 $cm^2$, although other sizes are used provided the surface area is sufficient to counteract curling in the opposing area of the substrate and also remain small enough so the affected area of the substrate does not extend into areas where curling is not an issue. The controller can operate the switching network 84 at a rate that enables a portion of a longitudinal array of tile segments in the cross-process direction to interact with moisture from the trough 64 before rotating into contact with a portion of the substrate S. In one embodiment, the controller operates the ejectors in the printhead modules at a rate of 40 kHz to produce 1200 dots per inch (dpi) in the process direction. By switching the network 84 at a rate of 333 Hz (40 kHz/120) the resolution of the applicator is about 10 dpi in the process direction as the applicator encounters the substrate after the roller 60 rotates 180° after the tile segments have been biased or unbiased to receive or be impervious to the water vapor, respectively, arising from the trough 64. In the embodiment being discussed, the length of the longitudinal array in the process direction is about 10 drops or about 2.54 mm (2.54 cm/100).

The tile segments in the longitudinal array are so-called smart surface tiles. These tiles are configured to be superhydrophobic when no electrical charge is applied to a tile and then the tile becomes superhydrophilic when an electrical charge is applied to the tile. The electrical charge necessary to produce this change need be no more that about 1 to 1.5 volts. Such a smart surface tile has been developed by researchers at the University of Britsh Columbia. Thus, when the tile segments on the roller 60 are selectively and independently biased electrically by operating the switching network 84, they become hydrophilic, while the tile segments not electrically biased remain hydrophobic. Thus, portions of the longitudinal array receive and carry moisture while the other portions resist the moisture so it falls back into the trough 64. The controller identifies the segments to be electrically biased with reference to the image data used to operate the ejectors in the printheads. Specifically, the controller operates the switches to electrically bias the tile segments that are opposite areas of the substrate that receive ink coverage sufficient to curl a portion of the substrate when an image is printed on the substrate. These switches apply electrical energy until the roller rotates 180° so the moisture is transferred from the electrically biased tiles to the areas on the side of the substrate opposite the areas having sufficient ink coverage to curl a portion of the substrate. As the roller 60 rotates away from the substrate, the switches electrically biasing the tile segments are deactivated and all of the tile segments in the longitudinal array become hydrophobic until that portion of the roller is again directly opposite the trough 64.

To generate an image that is used to control the switching network 84, the controller generates a halftone image for each color separation in the image to be printed. For each portion of the image that corresponds to a segment on the roller 60 rotating toward the substrate, the number of drops to be ejected into that portion of the image is totaled and compared to a predetermined ink coverage threshold. If the number equals or exceeds the predetermined ink coverage threshold, a binary value corresponding to electrically biasing the corresponding tile segment is placed in the switching network image. Otherwise, the other binary value is stored in that image. This binary image is then used to operate the switching network to electrically bias the segment tiles selectively and independently as the roller either passes through the water vapor emitted from the trough 64 by the ultrasonic transducer 68 or through the water in the trough to wet the segment tiles that correspond to the areas of ink coverage sufficient to curl that portion of the substrate as the roller contacts that portion of the substrate. As used in this document, "sufficient to curl a portion of the substrate" means the sum of the number of drops in a substrate area corresponding to a tile segment exceeds the predetermined ink coverage threshold. The predetermined ink coverage threshold is determined empirically and is affected by the type of substrate, the type of ink, and related parameters.

For duplex printing, the printed substrate moves past the printhead modules and the printed image is radiated by dryer 88 to remove water and other solvents from the ink on the substrate. As used in this document, the term "dryer" means any device configured to apply energy to a substrate to remove fluids from the substrate. Such dryers are known and can be implemented with convection heaters, microwave radiators, infrared radiators, and the like. The substrate is then turned over in a known manner, such as a reversing transport path or turn bar, and returned to the portion of the transport system 14 that feeds the substrate by the printhead modules. The dried image on the substrate now faces the roller 60 when the substrate contacts the roller 60. Application of the moisture to the dried image does not adversely impact the image quality of the dried image. The duplex image can then exit the printer or move to other components for further processing.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An aqueous ink printer comprising:

at least one printhead configured to eject drops of an aqueous ink;

a substrate transport system configured to move substrates past the at least one printhead to enable the at least one printhead to eject drops of the aqueous ink onto the substrates to form aqueous ink images on the substrates;

a moisture applicator configured with a plurality of tile segments to apply moisture selectively to a side of the substrates opposite a side on which the at least one printhead forms aqueous ink images on the substrates, each tile segment being configured to be hydrophobic when not electrically biased and to be hydrophilic when electrically biased; and a switching network having a plurality of switches, the switching network being configured to apply electrical energy to electrically bias the tile segments independently and selectively.

2. The aqueous ink printer of claim 1 wherein the moisture applicator includes a roller on which the tile segments are arranged.

3. The aqueous ink printer of claim 2 wherein the switching network is further configured to apply DC electrical energy independently and selectively to the tile segments.

4. The aqueous ink printer of claim 3 wherein the DC electrical energy has an electrical potential in a range of about 1.0 volt to about 1.5 volts.

5. The aqueous ink printer of claim 2, the moisture applicator further comprising:

a trough configured to hold water;

an ultrasonic transducer positioned in the water, the ultrasonic transducer being configured to generate vibrations that produce water vapor from the water in the trough; and the roller of the moisture applicator is positioned to contact the water vapor produced by the ultrasonic transducer.

6. The aqueous ink printer of claim 5 wherein the roller of the moisture applicator is positioned at a distance in a range of about 1.0 cm to about 30.0 cm from a volumetric center of the trough.

7. The aqueous ink printer of claim 2, the moisture applicator further comprising:

a tough configured to hold water; and the roller of the moisture applicator is partially immersed in the water contained in the trough.

8. The aqueous ink printer of claim 1 wherein the at least one printhead is positioned to form ink images on the substrates before the moisture applicator applies moisture to the substrates.

9. The aqueous ink printer of claim 1 wherein the at least one printhead is positioned to form ink images on the substrates after the moisture applicator applies moisture to the substrates.

10. The aqueous ink printer of claim 1 further comprising:

a controller operatively connected to the at least one printhead and the switching network, the controller being configured to operate the switching network to selectively and independently bias the tile segments of the moisture applicator electrically, the electrically biased tile segments corresponding to areas of the substrates on which the at least one printhead produces area ink coverage sufficient to curl a portion of the substrate.

11. The aqueous ink printer of claim 10 further comprising:

a dryer; and a device configured to reverse the substrates so the moisture applicator applies moisture to the dried ink images when the substrates pass over the roller of the moisture applicator; and the controller is further configured to operate the switching network using data for the ink image on a side of the substrates opposite the side to which the moisture applicator applies moisture.

12. The aqueous ink printer of claim 1, the controller being further configured to:

render data for an image to be formed on a substrate and generate halftone data for the image; and generate a binary image using the haltone data, the binary image being used to operate the switching network.

13. The aqueous ink printer of claim 12, the controller being further configured to:

identify a total number of ink drops to be ejected into an area of an ink image on the substrate;

compare the total number of ink drops for the area to a predetermined ink coverage threshold; and store a binary value in the binary image that indicates the switching network is operated to electrically bias one of the tile segments at a position that corresponds to the area of the ink image on the substrate that has the total of ink drops that equals or exceeds the predetermined ink coverage threshold.

14. A moisture applicator comprising:

a plurality of tile segments, each tile segment being configured to be hydrophobic when the tile segment is not electrically biased and to be hydrophilic when the tile segment is electrically biased; and a switching network having a plurality of switches, the switches being operatively connected to the plurality of tile segments and the switching network being configured to independently and selectively bias the tile segments in the plurality of tile segments electrically.

15. The moisture applicator of claim 14 further comprising:

a roller on which the plurality of tile segments is arranged.

16. The moisture applicator of claim 15 wherein the switching network is further configured to apply DC electrical energy independently and selectively to the tile segments in the plurality of tile segments.

17. The moisture applicator of claim 16 wherein the DC electrical energy has an electrical potential in a range of about 1.0 volt to about 1.5 volts.

18. The moisture applicator of claim 15 further comprising:

a trough configured to hold water;

an ultrasonic transducer positioned in the water, the ultrasonic transducer being configured to generate vibrations that produce water vapor from the water in the trough; and the roller of the moisture applicator is positioned to contact the water vapor produced by the ultrasonic transducer.

19. The moisture applicator of claim 15 further comprising:

a tough configured to contain water; and the roller is partially immersed in the water contained in the trough.

20. The moisture applicator of claim 15 wherein the tile segments have a polygonal shape that contiguously covers a surface of the roller.

21. The moisture applicator of claim 20 wherein the tile segments have a hexagonal shape.

* * * * *